United States Patent [19]

Peters et al.

[11] Patent Number: 4,708,787

[45] Date of Patent: Nov. 24, 1987

[54] METHOD FOR SUPPLYING A UNIFORM LIQUID AND GASEOUS MIXTURE

[75] Inventors: Albert W. Peters, Alvin, Tex.; Gregory J. MacCallum, Marlboro, Mass.

[73] Assignee: Amoco Corporation, Chicago, Ill.

[21] Appl. No.: 851,530

[22] Filed: Apr. 14, 1986

[51] Int. Cl.[4] ..... C10G 9/16

[52] U.S. Cl. ..... 208/130; 208/106; 208/48 Q; 585/648

[58] Field of Search ..... 208/106, 130, 48 Q, 208/129; 585/652, 648, 950; 165/DIG. 2, 111, 1, 60; 422/194; 239/132, 132.1, 132.3, 132.5

[56] References Cited

U.S. PATENT DOCUMENTS

| | | | |
|---|---|---|---|
| 2,371,147 | 3/1945 | Burk | 585/652 |
| 4,097,544 | 6/1978 | Hengstebeck | 585/652 X |
| 4,136,015 | 1/1979 | Kamm et al. | 208/130 X |
| 4,233,137 | 11/1980 | Ozaki et al. | 208/48 Q |
| 4,279,734 | 7/1981 | Gwyn | 208/130 X |
| 4,397,740 | 8/1983 | Koontz | 208/130 X |
| 4,405,440 | 9/1983 | Gwyn | 208/130 X |
| 4,527,002 | 7/1985 | Kamisaka et al. | 208/130 X |
| 4,548,706 | 10/1985 | Papadopoulos et al. | 208/130 |

*Primary Examiner*—Andrew H. Metz
*Assistant Examiner*—Glenn Caldarola
*Attorney, Agent, or Firm*—Robert G. Ladd; Wallace L. Oliver; William H. Magidson

[57] ABSTRACT

The method and apparatus are used to disperse a liquid component throughout a gaseous component and to supply a uniform mixture of components to a heat exchanger in a process for thermal cracking hydrocarbons. The method for supplying the mixture of components from a nonuniform mixture includes several supply steps. First, the nonuniform mixture is separated into liquid and gaseous components. Then, the flow of gaseous component is accelerated to a high velocity. Next, the liquid component is dispersed through the gaseous component in a region of its high velocity flow to obtain a uniform mixture. Finally, the uniform mixture is supplied to the heat exchanger through an outlet conduit.

The method is preferably accomplished with an assembly that is fabricated from a number of components. An inlet conduit supplies the gaseous component to a venturi which accelerates the flow velocity of the gaseous component in the assembly. A liquid supply conduit provides the liquid component to an atomizer in the assembly. The atomizer is concentrically located within a throat of the venturi and disperses the liquid component through the gaseous component to obtain a uniform mixture. The uniform mixture is then supplied through an outlet conduit to the heat exchanger.

2 Claims, 7 Drawing Figures

METHOD FOR SUPPLYING A UNIFORM LIQUID AND GASEOUS MIXTURE

BACKGROUND OF THE INVENTION

This application relates to a method and apparatus including a dispersement nozzle assembly for dispersing a liquid component throughout a gaseous component to promote heat transfer in a heat exchanger. More specifically, the present invention relates to the combination of such a dispersement nozzle assembly with a plate fin heat exchanger in a process for thermal cracking of hydrocarbons for promoting the establishment of a relatively uniform liquid and gaseous mixture to facilitate and improve heat transfer.

A number of devices and methods for dispersing a liquid component in a gaseous component have been previously proposed. Examples of previously proposed devices and methods for dispersing liquid components within a gaseous medium are described in a number of U.S. patents and a sampling of such patents is set forth below:

U.S. Pat. No. 3,613,333 describes a PROCESS AND APPARATUS FOR CLEANING AND PUMPING CONTAMINATED INDUSTRIAL GASES. The apparatus includes a liquid injecting nozzle or a plurality of nozzles located upstream of a venturi conveying contaminated industrial gas.

The non-analogous U.S. Pat. No. 3,807,145 describes an INJECTOR TYPE COOLING TOWER. FIG. 12 of this non-analogus patent illustrates a scheme whereby a plurality of nozzles extend across the centerline of the narrowest cross-section of a rectangular conduit to partially entrain water in air in a cooling tower for cooling water.

U.S. Pat. No. 3,923,466 describes an APPARATUS FOR THE PRODUCTION OF CRACKED GAS. The apparatus includes a nozzle located upstream of an expansion throat where super-heated steam is mixed with reaction materials.

U S. Pat. No. 4,288,408 describes an APPARATUS FOR THE DIACRITIC CRACKING OF HYDROCARBON feeds for the selective production of ethylene and synthetic gas. A combustible mixture is established by supplying fuel through ports adjacent concentric oxygen ports, which are concentric about a longitudinal axis of the reactor. Feedstock is circumferentially injected into a constriction throat through a plurality of feedstock injectors.

The non-analogous U.S. Pat. No. 4,058,378 describes a HEAT TRANSFER DEVICE for cooling water. The heat transfer device described in this non-analogous patent for cooling water includes a relatively large air duct which is open to ambient air at its upstream end where there is an annular coaxial nozzle to jet hot water through a venturi tube towards the downstream end of the air duct. The high velocity stream of water draws air into the low pressure zone to intermix with the finely divided water droplets moving downstream. In some embodiments, a fan may augment air flow. The water is cooled by a heat transfer of the heat of vaporization as well as by heat transfer from the air itself, whereby water drawn from the downstream end of the air duct is cooled to a temperature suitable for recycling the water.

None of these patents disclose a dispersement nozzle including a venturi throat surrounding an atomizer coaxially mounted within the venturi, which not only improves heat transfer but also improves hydrogen recovery in a process for thermal cracking of hydrocarbons.

A description of a method for thermally cracking hydrocarbons is contained in U.S. Pat. No. 4,548,706, issued Oct. 22, 1985, to Papadopoulos et al which is owned by the assignee of the present application. The disclosure of this patent is incorporated herein by reference.

The method and apparatus of the present invention differs from the known method by providing a method and apparatus for supplying a uniform liquid and gaseous mixture to a heat exchanger in a separation stage in a process for thermal cracking of hydrocarbons in which a nonuniform liquid and gaseous mixture is produced and by providing an improved method to obtain an increased hydrogen rich fraction.

SUMMARY OF THE INVENTION

According to the present invention there is provided a method for supplying a uniform liquid and gaseous mixture to a heat exchanger in a separation stage in a process for thermal cracking of hydrocarbons in which a nonuniform liquid and gaseous mixture is produced, said method comprising:

separating the nonuniform liquid and gaseous mixture into a liquid component and a gaseous component;

accelerating the flow rate of the gaseous component;

dispersing the liquid component into the gaseous component by injecting the liquid through an atomizer located in the maximum flow region of the accelerated flow; and supplying a uniform liquid and gaseous mixture, resulting from the injection of the liquid component into the accelerated flow of the gaseous component, to a heat exchanger.

The step of accelerating is preferably accomplished by causing the gaseous component to flow through a venturi and the liquid component is dispersed into the maximum flow region of the venturi.

There is further provided a mixer for supplying a uniform mixture of liquid and gaseous components to a heat exchanger in a separation stage in a process for thermal cracking of hydrocarbons comprising:

an inlet conduit for conveying a gaseous component through a lumen of said inlet conduit;

a liquid supply conduit for conveying a liquid component through a lumen of said liquid supply conduit;

accelerator means communicating with said inlet conduit for accelerating the flow of the gaseous component to a high velocity;

dispersement means communicating with said liquid supply conduit and said accelerator means for dispersing the liquid component throughout the gaseous component in a region where the gaseous component is flowing at substantially its highest velocity for obtaining a uniform mixture of liquid and gaseous components; and an outlet conduit in communication with said accelerator means for supplying the uniform mixture of liquid and gaseous components to a heat exchanger in a separation stage in a process for thermal cracking of hydrocarbons.

DESCRIPTION OF THE PREFERRED EMBODIMENT

In the practice of the teachings of the present invention, a novel dispersement nozzle assembly is incorporated into an apparatus in a separation stage in a process for thermally cracking hydrocarbons to improve heat transfer in a heat exchanger of the apparatus and to improve hydrogen recovery. These improvements are obtained by employing the dispersement nozzle assembly in a method for supplying a uniform liquid and gaseous mixture to a heat exchanger.

Figure 1:
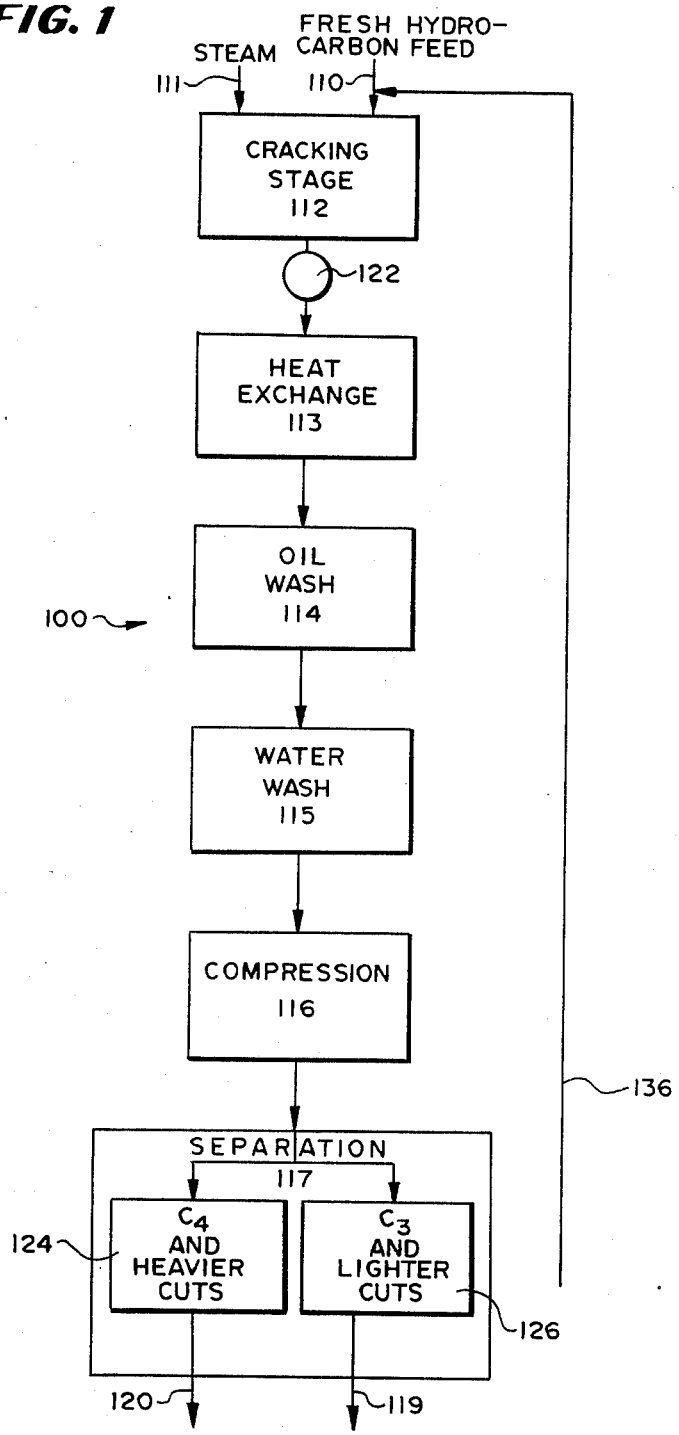
FIG. 1 is a block flow diagram of a portion of a thermocracking process in conjunction with which the method and apparatus of the present invention is advantageously used.

Referring now to FIG. 1 in greater detail, there is illustrated therein a simplified block flow diagram of a portion of a process 100 with which the method and apparatus of the present invention are used to improve heat transfer and hydrogen recovery.

The process 100 includes a single feed input line 110 which contains a feedstock comprising at least one hydrocarbon selected from the group of paraffins containing up to ten carbon atoms, naphthas, gas oils, and mixtures thereof from which hydrogen, methane, olefins, naphthenes, and aromatics are produced. The single feed input line is coupled to a reactor in a cracking stage 112. Some recycled olefin product combined with fresh feed may be supplied to the reactor. Steam is also supplied to the reactor in the cracking stage 112 via an input line 111.

In the cracking stage 112, the feedstock is thermally cracked to form a mixture of products typically including hydrogen, methane, ethylene, propylenes, butenes, butadiene, naphthenes, and like aromatics as well as some higher molecular weight materials such as fuel oil, and polyaromatics whose boiling points exceed 212° C.

The reactor effluent from cracking stage 112 is passed to a heat exchange stage 113, where the effluent is cooled and the cracking reaction quenched.

The cooled effluent is then passed to an oil wash stage 114 and a water wash stage 115.

At the oil wash stage 114 organic compounds which contain at least 5 carbon atoms are removed.

At the water wash stage 115 water soluble inorganic gases are removed.

The remaining effluent is then passed to a compression stage 116 for pressurization and then to a separation stage 117 where the mixture is separated by any convenient and conventional techniques into as many fraction lines, e.g., lines 119, 120, as may be desired. An additional pressurization stage 122 is shown, for convenience, upstream immediately following the cracking stage 112. However, the additional pressurization stage 122, if used, may be located anywhere in the process line intermediate the cracking stage 112 and the compression stage 116.

In separation stage 117, C4 and heavier cuts are separated out into a "heavy cut" 124 and supplied to line 120 while a lighter fraction comprising C3 and lighter cuts are separated out into a "light cut" stage 126 and supplied to line 119.

Figure 2:
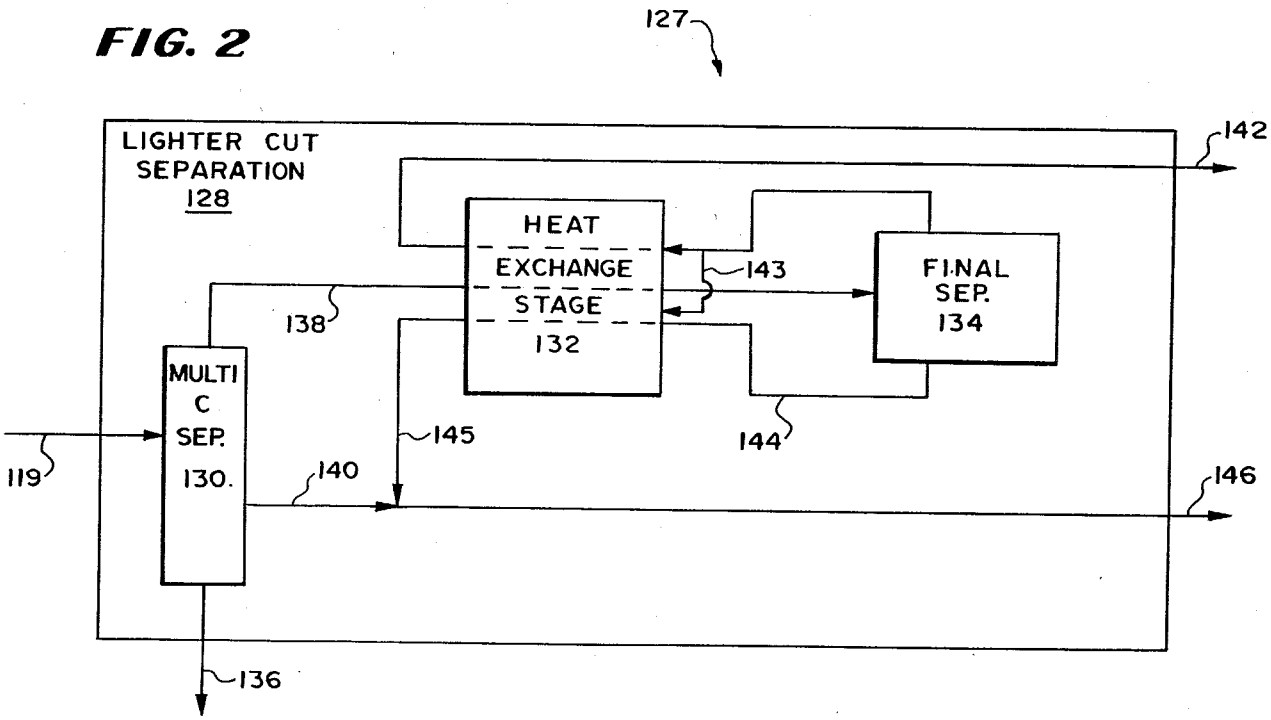
FIG. 2 is a continuation of a portion of the diagram shown in FIG. 1 and shows a "lighter cut separation" stage of the process wherein the method and apparatus of the present invention are utilized.

The fraction in line 119 is fed to a process stage 127 of the present invention illustrated in FIG. 2 of the drawing which comprises a lighter cut separation stage 128. The fraction or feedstream in line 119 containing C3 and lighter cuts are caused to pass through a plurality of separators and heat exchangers contained within the lighter cut separation stage 128 as shown.

These separators include a multicarbon compound separator 130, a heat exchanger 132, and a final separator 134. The C3 fraction is separated in the multicarbon compound separator 130 into a multicarbon compound fraction 136, a monocarbon compound fraction 140 and a hydrogen fraction 138.

A portion of multicarbon compound fraction 136 is recycled to the cracking stage 112. The hydrogen fraction 138 contains hydrogen, carbon monoxide, and some methane.

The monocarbon compound fraction 140 contains methane with some vestiges of the multicarbon compound fraction including ethane and ethylene.

In one embodiment of the process 100, multiple heat exchangers can be employed in heat exchange stage 132 to simultaneously exchange heat among differing streams.

The fraction in output line 140 from separator 132 is a nonuniform liquid and gaseous mixture containing both a liquid, mostly methane, and gaseous components.

The hydrogen fraction is supplied via hydrogen fraction line 138 through the heat exchange stage 132 to a final separator 134. In the heat exchange stage 132, the hydrogen fraction in line 138 is cooled by exchanging heat with the hydrogen rich fraction supplied by output line 142 from the final separator 134 and by exchanging heat from a combination of streams according to the teachings of the present invention. The liquid component, the methane rich fraction supplied by line 144, is injected into a maximum flow region of the gaseous component, a portion of the hydrogen rich fraction supplied by take-off line 143, in the heat exchange stage 132 to obtain a mixture of uniformly dispersed liquid and gaseous components to promote heat transfer.

By improving the heat transfer in the heat transfer stage 132, the hydrogen fraction in line 138 is recovered to a greater degree. Thereby, at a constant rate of hydrogen recovery, in the hydrogen recovery unit in a process for the thermal cracking of hydrocarbons, a higher purity hydrogen is obtained or at a constant hydrogen purity, increased hydrogen recovery can be obtained with the teachings of the present in- vention.

The final separator 134 and heat exchange stage 132 include an accelerator mechanism, a dispersement mechanism, and a heat exchange system for producing a hydrogen rich fraction which is supplied to output line 142 and a methane rich fraction which is supplied to output line 144 and combined with the monocarbon compound fraction 140 to form the methane rich fraction supplied to output line 146.

The hydrogen rich fraction in line 142 contains 5 to 15 percent (by volume) methane, less than 0.5 percent (by volume) carbon monoxide with the remainder being hydrogen.

The methane rich fraction in line 146 contains 50 to 80 percent (by volume) methane, less than 1 percent (by volume) ethylene, less than 0.5 percent (by volume) ethane with the remainder being hydrogen.

Processes employing a heat exchanger to obtain hydrogen and methane rich fractions from a nonuniform mixture of hydrogen and methane in liquid and gaseous components are well understood and conventional. However, the method of the present invention for producing improved yields of hydrogen in greater purity is believed to be unique in preparing and processing a nonuniform mixture, the fraction in line 144, for presentation to a heat exchanger system in the heat exchange stage 132.

The final separator 134 receives the cooled hydrogen fraction in line 138 and separates the hydrogen fraction into a hydrogen rich fraction in line 142 and a methane rich fraction in line 144. A portion of the hydrogen rich fraction in line 142 is taken off in line 143 for use as the gaseous component and the methane rich fraction in line 144 is used as the liquid component in the method the present invention. The gaseous component has its flow rate accelerated to a relatively high velocity by the accelerator mechanism. The preferred flow rate is approximately one half Mach velocity.

According to the teachings of the present invention, the liquid component is injected into a maximum flow region of the gaseous component in the heat exchange stage 132 by a dispersement system to obtain a relatively uniform mixture of the liquid and gaseous components which is presented to the heat exchange system. As will be described in greater detail hereinafter in connection with the description of FIGS. 3–7, the accelerator mechanism and the dispersement mechanism for performing the accelerating and dispersement steps of the process are provided in a dispersement nozzle assembly 210 (FIG. 3) constructed according to the teachings of the present invention.

The steps of the final separation stage 134 include receiving a nonuniform liquid and gaseous mixture, separating the nonuniform liquid and gaseous mixture into a liquid component and a gaseous component, recombining the liquid and gaseous fraction to form a uniform liquid and gaseous mixture and supplying same to the heat exchange stage 132.

In process stage 127 the flow rate of the separated gaseous component is accelerated by causing the gaseous component to flow through a venturi. In some instances, a compressor could be considered to be the equivalent of the venturi.

Additionally, in process stage 127 the separated liquid component is dispersed into the gaseous component by injecting the component liquid into the gaseous component through an atomizer which is located in the area of maximum flow of the gaseous component. Then the uniform liquid and gaseous mixture resulting from the injection of the liquid component into the accelerated flow of the gasous component is supplied to the heat exchange stage 132 in process stage 127. This method may be employed as an improvement in the process disclosed and claimed in U.S. Pat. No. 4,548,706 to Papadopoulos et al.

It has been found that employment of the method step described above in process stage 127 improves both the purity of the hydrogen and the amount of hydrogen recovered. It is believed that the improved heat transfer between the gaseous component and the liquid component achieved by dispersing liquid droplets into the accelerated flow of the gaseous component results in the improved purity and amount of recovery of the hydrogen. From initial pilot tests using process stage 127, it was projected that an increase of purity up to 95 mol percent purity of hydrogen is obtainable with a recovery amount of hydrogen between 22 and 80 percent.

Then in use of process stage 127 in a production run of the process 100, although not operated at design conditions, the purity of the recovered hydrogen was increased by about 5 mol percent at a 50 percent recovery factor. Later production runs revealed that use of the process stage 127 resulted in 90 percent mol purity of hydrogen and a recovery range of hydrogen between about 22 percent and 80 percent. The earlier best recovery amount of hydrogen achieved was 55 percent.

EXAMPLE 1

In hydrogen recovery units in a process for the thermal cracking of hydrocarbons, two units were operated at a constant recovery rate of 60.5% of available hydrogen. At this constant recovery rate of 60.5%, the unit with the dispersion device produced hydrogen with a 91.7 volume percent purity. The hydrogen recovery unit without the dispersion device produced hydrogen with a 89.5 volume percent purity.

EXAMPLE 2

In hydrogen recovery units in a process for the thermal cracking of hydrocarbons, two units were operated at a constant purity of 91.0 volume percent. At this constant purity of 91.0 volume percent, the hydrogen recovery unit with the dispersion device produced a recovery of 68.6 percent of the available hydrogen. The hydrogen recovery unit without the dispersion device recovered 58.2 percent of the available hydrogen.

Figure 3:
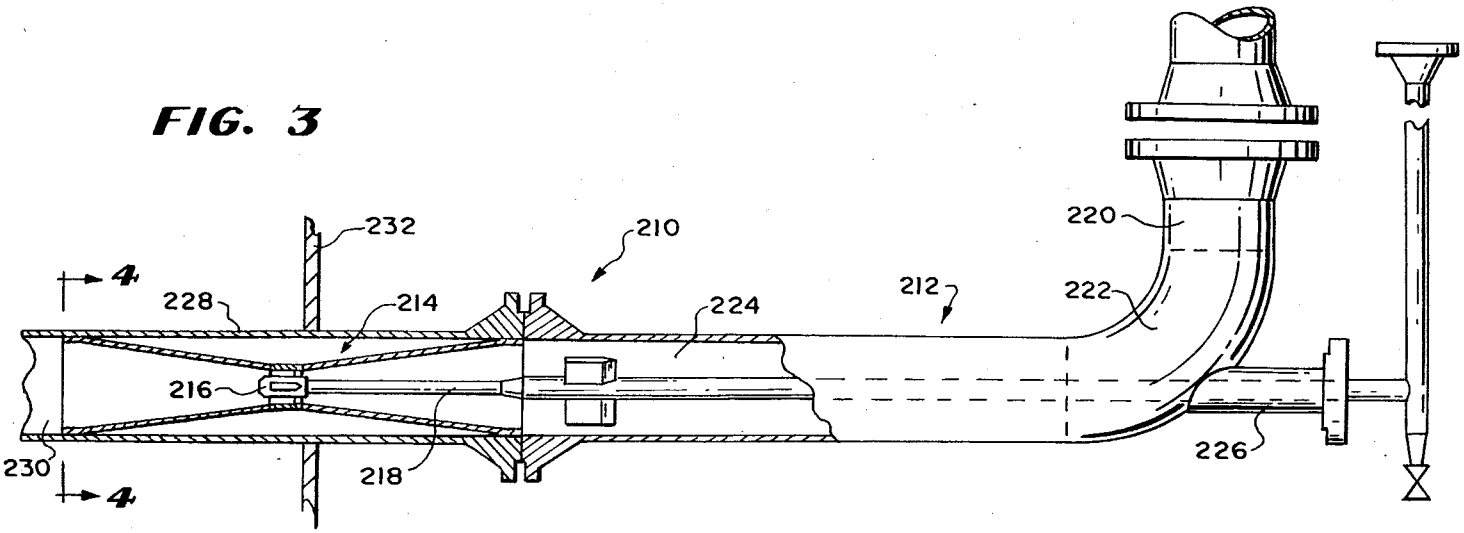
FIG. 3 is a side elevational view, partially in-section, of a dispersement nozzle assembly of the apparatus of the present invention, and a portion of the environment in which it is mounted.
Figure 4:
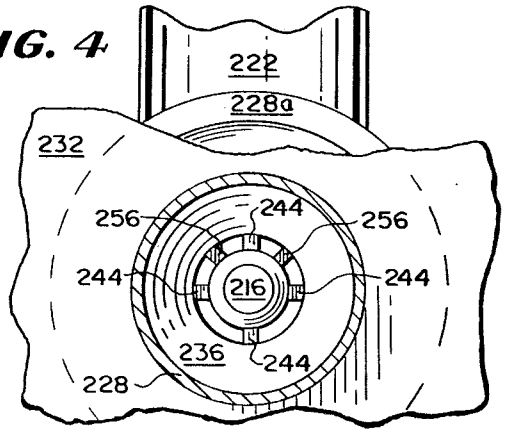
FIG. 4 is a vertical sectional view of the dispersement nozzle assembly viewing same from its downstream end, and is taken along line 4—4 of FIG. 3.

Referring now to FIG. 3 of the drawing, there is illustrated therein a dispersement nozzle assembly 210 constructed according to the teachings of the present invention and a portion of the environment in which it is mounted. The dispersement nozzle assembly 210 acts as a mixer, and includes an inlet conduit 212 for conveying a gaseous component through a lumen 213 thereof. Inlet conduit 212 communicates with a venturi portion 214 where the flow rate of the gaseous component is increased to approximately one half Mach. An atomizer 216 is located in the high velocity flow region of the venturi portion 214 to disperse droplets of a liquid component into the gaseous component in a manner whereby virtually all of the liquid component is entrained in the flow of the gaseous component.

The liquid component is supplied to the atomizer 216 via a liquid supply conduit 218.

In FIG. 3, the upstream flows of the liquid and gaseous components are located on the right side of the figure and the downstream flow or outlet side of the nozzle assembly 210 are located on the left side of the figure. A plate fin heat exchanger is usefully located downstream of but closely to the outlet side of the dispersement nozzle assembly 210 to facilitate development of a hydrogen rich fraction which is diverted from a methane rich fraction in the process 100 for the thermal cracking of hydrocarbons described above.

As shown in FIG. 3, the inlet conduit 212 is a flanged stainless steel pipe and includes inlet pipe portion 220, an elbow portion 222, a presentation pipe portion 224, and a coaxial inlet portion 226 joined to the elbow portion 222 for coaxially locating the axis of the inlet portion 226 with the axis of the presentation pipe portion 224. The presentation pipe portion 224 of the inlet conduit 212 is joined by a flanged connection to a shell pipe 228 circumferentially surrounding the venturi 214. The shell pipe 228 extends and continues downstream of the venturi portion 214 to an outlet conduit 230 after passing through a wall 232 of the heat exchange stage 132.

The outlet conduit 230 provides a means for supplying a heat exchanger with the uniform liquid and gaseous mixture developed in the venturi portion 214. Both the shell pipe 228 and the outlet conduit 230 are fabricated from stainless steel.

Figure 5:
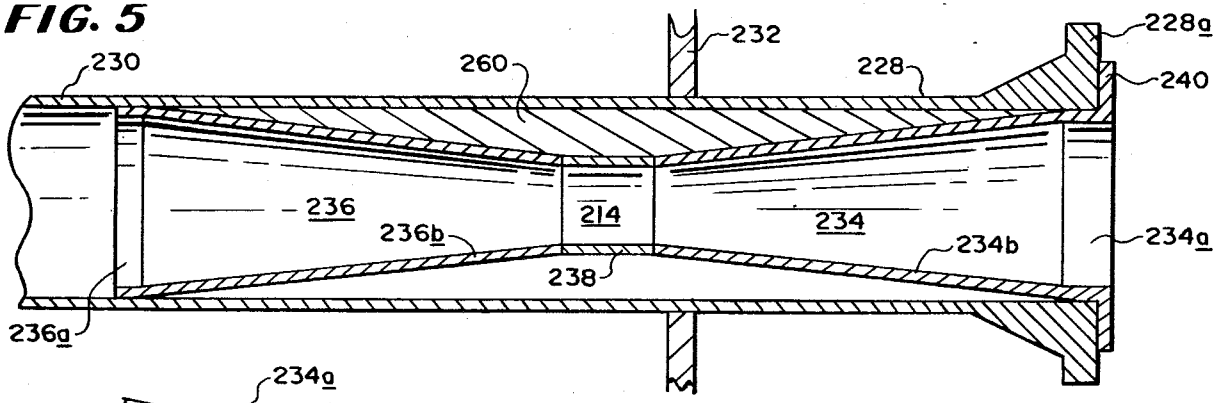
FIG. 5 is a longitudinal sectional view of a venturi portion of the dispersement nozzle assembly of the present invention shown in FIG. 3 with a liquid supply conduit and atomizer portion of the nozzle assembly removed.

The venturi portion 214 and associated structure is illustrated in enlarged scale in FIG. 5 of the drawings. The venturi portion 214 is advantageously assembled into an intergral structure from three basic stainless steel components joined by welding. In this respect, a tapered inlet portion 234 is joined to tapered outlet portion 236 by a venturi throat portion 238. The welded joints between the tapered inlet 234 and the venturi throat portion 238 and between the venturi throat portion 238 and the tapered outlet portion 236 are advantageously ground smooth on their internal surfaces. The tapered inlet portion 234, as can be readily seen from FIG. 5, is substantially similar to tapered outlet portion 236. Each has a cylindrical section 234*a*, 236*a*, respectively, and tapers radically inward at approximately an angle of 15° in convergent section 234*b*, 236*b* respectively, to the venturi throat portion 238. The venturi portion 214 is approximtely 2 feet long and has a throat internal diameter of about 2 inches.

Figure 6:
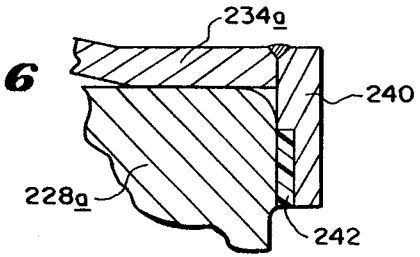
FIG. 6 is an enlarged cross section of a double weld between a shell pipe of the apparatus and the venturi portion of the dispersement nozzle assembly.

At the upstream end of the venturi portion 214, a venturi flange 240 provides an abutment which is welded to the cylindrical inlet section 234*a*, as shown in FIG. 6 which is an enlarged detail of the joinder between the shell pipe 228 and the venturi portion 214.

The venturi flange 240 is joined to the cylidrical inlet portion 234*a* by a 'V' weld and the internal diameter of shell pipe flange 228*a* is rounded to approximately ½ inch radius. A polytetrafluoroethylene filler 242 surrounds the outer circumference of the venturi flange 240 to fill the gap between the face of the shell pipe flange 228*a* and the venturi flange 240.

Figure 7:
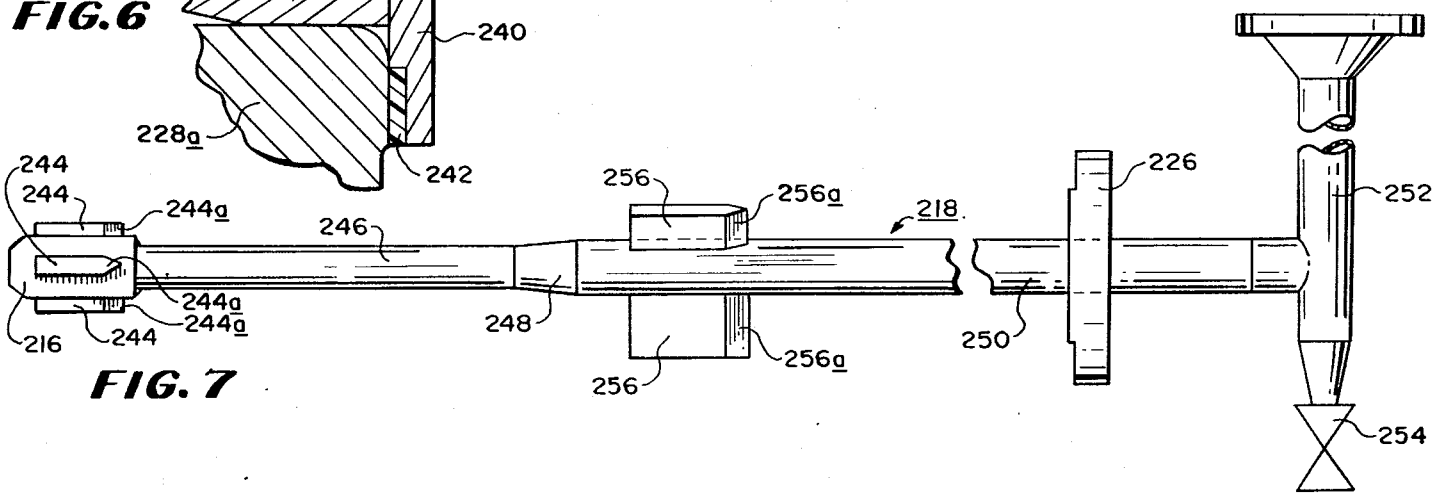
FIG. 7 is a side plan view of the liquid supply conduit and atomizer of the nozzle assembly portion of the dispersement nozzle assembly of the present invention.

The atomizer 216, the liquid supply conduit 218, and associated components are shown in enlarged scale in FIG. 7 of the drawing. The atomizer 216 must disperse the liquid component thoroughly throughout the gaseous component to achieve the improvement desired in the heat transfer of the liquid and gaseous mixture in the downstream heat exchanger. One nozzle suitable for this purpose is manufactured by Spraying Systems Co. and called a FULL JET NOZZLE 15°, Model No. 1H1S280.

As shown, four atomizer vanes 244 are welded to the atomizer 216, 90° apart, and support the atomizer 216 within the venturi throat portion 238. The atomizing vanes 244 present tapered edge portions 244*a* to the flow of the gaseous component at their upstream end.

The atomizer 216 is seal welded to the liquid supply conduit outlet portion 246.

The liquid supply conduit 218 includes an outlet portion 246, a reducer portion 248 and a feed portion 250. In common with the other components of the dispersement nozzle assembly 210 of the present invention, they are fabricated from stainless steel and welded to each other. The feed portion 250 passes through the flange of the coaxial inlet portion 226 of the inlet conduit 212. As its name implies, liquid supply conduit 218 conveys liquid from the feed pipe 252 to the atomizer 216. The feed pipe 252 is operatively connected upstream of the dispersement nozzle assembly 210 to convey the liquid component to the liquid supply conduit 218. Downstream of the connection between a feed portion 250 and the feed pipe 252, a valve 254 is located. The liquid supply conduit 218 is supported coaxially within the inlet conduit 212 by supply vanes 256 welded 120° apart only to the feed portion 250. The supply vanes 256 also present tapered end portions 256*a* to the flow of the gaseous component within the inlet conduit 212 at their upstream ends.

Similarly, the venturi portion 214 is supported by webs 260 spaced 120° on its periphery. The webs 260 are only welded to the outer periphery of the venturi portion 214 and provide support for the venturi portion 214 within the shell pipe 228.

The dispersement nozzle assembly 210 can largely be field fabricated and retrofitted to existing units in a process for the thermal cracking of hydrocarbon to improve hydrogen recovery. The venturi portion 214 is not secured to the shell pipe 228 at its downstream end.

The venturi portion 214 may be inserted into an existing outlet conduit 230 and welded to an existing flange. Likewise, the assembly including the atomizer 216 and the liquid supply conduit 218 may be inserted into the venturi portion 214 and into the gaseous inlet conduit 212.

The dispersement nozzle assembly 210 of the present invention is advantageously used to correct or mitigate a maldistribution of liquid and gaseous components. The liquid and gaseous (vapor) components must largely be separated from a nonuniform liquid and gaseous mixture before they are separately introduced to the dispersement nozzle assembly 210. The dispersement nozzle assembly 210 is particularly well suited to be employed in applications where the liquid and gaseous components are molecules of different densities, although it is also useful in applications where there is only one molecule in two phases. As long as a sufficient head pressure is present to disperse the liquid by means of the atomizer 216, beneficial improvements are realized. The dispersement nozzle assembly 210 of the present invention is particularly useful with hydrogen-methane mixtures and is incorporated into the process of thermal cracking of hydrocarbons disclosed in U.S. Pat. No. 4,548,706.

Also, from the foregoing description it will be apparent that modifications can be made to the dispersement nozzle assembly of the present invention and to the improved apparatus and method in which it is advantageously used without departing from the teachings of the invention. Accordingly, the scope of the invention is only to be limited as necessitated by the accompanying claims.

From the foregoing description, it will be apparent that the dispersement nozzle assembly of the present invention and the improved apparatus and method in which it is advantageously used have a number of advantages, some of which have been described above and others of which are inherent therein.

We claim:

1. A method for thermally cracking a feed comprising at least one hydrocaron selected from the group consisting of paraffins containing up to 10 carbon atoms, naphthas, gas oils and mixtures thereof to produce hydrogen, methane, olefins, naphthenes, and aromatics, comprising:

cracking said feed at high temperature in a reactor inthe presence of steam;

fractionating an effluent from said reactor;

fractionating the resulting C3 fraction in successive fractionating stages to obtain a fraction which substantially consists of molecules having a single carbon atom, such as carbon monoxide and methane, and hydrogen atoms in a nonuniform liquid and gaseous mixture where the liquid component is mainly methane;

separating the nonuniform liquid and gaseous mixture into a liquid component and a gaseous component;

accelerating the flow rate of the gaseous component to a high velocity;

dispersing the liquid component into the gaseous component by injecting fine droplets of the liquid component into the maximum flow region of the gaseous component to obtain a uniform liquid and gaseous component;

supplying the uniform liquid and gaseous mixture to a heat exchanger; and partitioning the effluent from the heat exchanger into a hydrogen rich fraction and a methane rich fraction.

2. the method of claim 1 wherein the step of accelerating the flow rate of the gaseous component results in a flow velocity of approximately one half Mach speed.

* * * * *

UNITED STATES PATENT OFFICE
CERTIFICATE OF CORRECTION

Patent No. 4,708,787 Dated November 24, 1987

Inventor(s) Albert W. Peters, Gregory J. MacCallum

It is certified that error appears in the above-identified patent and that said Letters Patent are hereby corrected as shown below:

| Patent Column | Line | |
|---|---|---|
| 4 | 65 | reads "in-vention" and should read "invention" |
| 5 | 30-31 | reads "method the" and should read --method of the-- |
| 9 | 6 | reads "hydrocaron" and should read --hydrocarbon-- |
| 9 | 13 | reads "inthe" and should read --in the-- |
| 10 | 17 | reads "the" and should read --The-- |

Signed and Sealed this

Twenty-first Day of February, 1989

*Attest:*

DONALD J. QUIGG

*Attesting Officer*

*Commissioner of Patents and Trademarks*